US005099524A

United States Patent [19]

Linday

[11] Patent Number: 5,099,524

[45] Date of Patent: Mar. 31, 1992

[54] SEGMENTED CAP ASSEMBLY

[76] Inventor: Nancy L. Linday, 17 E. 97th St., New York, N.Y. 10029

[21] Appl. No.: 605,660

[22] Filed: Oct. 29, 1990

[51] Int. Cl.[5] ..... A42C 5/02

[52] U.S. Cl. ..... 2/181; 2/10; 2/12; 2/171; 2/171.1; 2/195; 2/209.1; 2/DIG. 6

[58] Field of Search ..... 2/10, 12, 171, 171.1, 2/171.2, 181, 181.4, 182.4, 185 R, 195, 196, 199, 209.1, DIG. 6

[56] References Cited

U.S. PATENT DOCUMENTS

| | | | |
|---|---|---|---|
| 757,854 | 4/1904 | Wickersham | 2/12 |
| 1,598,314 | 8/1926 | Rosenberg | 2/10 |
| 4,023,212 | 5/1977 | Huffman | 2/DIG. 6 |
| 4,096,589 | 6/1978 | Goldstein | 2/12 |
| 4,131,953 | 1/1979 | Kimotsuki | 2/171.1 |
| 4,547,903 | 10/1985 | Brown | 2/DIG. 6 |
| 4,630,317 | 12/1986 | Brown | 2/171 |
| 4,811,430 | 3/1989 | Janusz | 2/171 |
| 4,873,726 | 10/1989 | Tapia | 2/171.1 |
| 4,941,210 | 7/1990 | Konucik | 2/171 |
| 4,993,079 | 2/1991 | Johnson | 2/181 |

FOREIGN PATENT DOCUMENTS

| | | | |
|---|---|---|---|
| 569860 | 2/1959 | Canada | 2/181 |
| 637556 | 5/1928 | France | 2/10 |
| 799062 | 6/1936 | France | 2/195 |
| 253402 | 11/1927 | Italy | 2/181 |
| 124654 | 4/1919 | United Kingdom | 2/181 |
| 258359 | 9/1926 | United Kingdom | 2/195 |
| 2070413 | 9/1981 | United Kingdom | 2/209.1 |

*Primary Examiner*—Werner H. Schroeder
*Assistant Examiner*—Diana L. Biefeld
*Attorney, Agent, or Firm*—Abdallah & Muckelroy

[57] ABSTRACT

A segmented cap assembly that includes selectively detachable crown component, sweatband component and visor component. The sweatband component is formed having a forward part made of hook and loop tape hook portion-engaging material. The crown component selectively attaches to the sweatband component by engagement of hook and loop tape material fixedly attached to the inside portion of the crown component to the upper half of the hook and loop tape hook portion-engaging material. The visor component selectively attaches to the sweatband component by engagement of hook and loop tape material fixedly attached to the inside portion of the visor component to the lower half of the hook and loop tape hook portion-engaging material.

11 Claims, 3 Drawing Sheets

SEGMENTED CAP ASSEMBLY

BACKGROUND OF THE INVENTION

The present invention generally relates to visored caps and more particularly to segmented caps, i.e. caps having detachable and interchangeable components.

Visored caps are widely used as marketing tools for virtually all types of companies and products, the forehead portion of a cap permitting highly visible display of a company logo, trademark or tradename. For visored caps having detachable and interchangeable components to be useful as marketing tools it is important that the cap be comfortable to the wearer and that the various components of the cap be easy to attach and detach to each other, since the wearer is likely to associate the displayed company with the cap's wearability. It is also important for marketing purposes that the cap have a neat and clean appearance in all of its various wear configurations. Furthermore, a segmented cap useful as a marketing tool should have means to display the logo, trademark or tradename in each of the various wear configurations. The visored caps of the prior art fail in one or more of the aforementioned aspects.

Various caps having detachable and interchangeable components are known in the prior art. U.S. Pat. No. 757,854 to Wickersham discloses a segmented cap comprising a sun visor detachably attachable to a headband. In U.S. Pat. No. 1,105,400 to Burke a segmented cap is disclosed having a reversible crown cover which permits crowns of different color to be exposed. U.S. Pat. No. 1,598,313 to Rosenberg discloses a segmented cap having a cap crown and detachable visor which can be used independently of each other. In the Rosenberg '313 cap the cap crown and the visor are united by a headband attached to the visor that has spaced studs selectively engaging sockets disposed in the cap crown. The forehead portion of the visor fits beneath the studded headband. Therefore when the headband is worn without the cap crown the studs are exposed and thereby diminish the impact, effectiveness and overall acceptability of the cap for display of a logo, trademark or tradename. If the cap crown of the Rosenberg '313 disclosure is used alone, the sockets thereof are brought into contact with the wearer's head which would be uncomfortable and potentially injurious to the wearer In U.S. Pat. No. 1,598,314 to Rosenberg a segmented cap having straps of the visor interconnecting with openings in the cap crown is disclosed. The aforementioned difficulties for use of the cap as a marketing tool are equally applicable to the Rosenberg '314 embodiment of a segmented cap.

U.S. Pat. No. 4,023,212 to Huffman discloses a segmented cap having an interchangeable crown portion removably affixed to the forehead portion of a visor by adhesive or self-engaging fastening means, for example hook and loop tape self-engaging fastening means as marketed under the trademark VELCRO. The crown portion of the Huffman cap is provided with fixedly. attached bands that pass through slits at the ends of the forehead portion of the cap for attachment thereto. The loop portion of the VELCRO fastening means is fixedly attached to the forward face of the forehead portion of the visor and the hook portion of the VELCRO fastening means is fixedly attached to the inside edge of the crown portion. In an alternative embodiment a single band attached at the ends thereof to the forehead portion of the cap is held attached to the crown portion by an overlapping flap secured by complementary portions of self-engaging fastening means disposed on respective parts of the crown portion. This alternative embodiment of the cap permits the visor to be worn separate from the crown portion. In either embodiment of the Huffman cap, the loop portion of the VELCRO fastening means is disposed on the forward face of the forehead portion of the visor to achieve the requisite neat appearance of the cap and if the visor is worn separately from the crown portion, the loop portion of the VELCRO fastening means diminishes the impact, effectiveness and overall acceptability of the cap for display of a company logo, trademark or tradename. Also, if the crown portion is worn separately, the hook portion of the VELCRO fastening means at the inside edge of the crown portion will irritate the wearer's forehead and the crown will not fit the head properly. Furthermore, to replace a crown in the Huffman cap requires at least four steps: (1) attach the crown to the fastening means on the forehead portion of the visor, (2) secure the band at one side of the forehead portion, (3) secure the band at the opposite side of the forehead portion, and (4) fasten the flap at the rear of the cap.

In U.S. Pat. No. 4,096,589 to Goldstein an adjustable eye shade is disclosed having a headband and a detachable visor element selectively attachable by hook and loop tape self-engaging fastening means. The headband is formed from or includes on a portion thereof absorbent fabric material forming a sweatband. The visor element does not include a forehead portion and the headband includes fastening means on its forward face and therefore is unsuitable as a marketing tool when worn separately. In U.S. Pat. No. 4,547,903 and U.S. Pat. No. 4,630,317 to Brown et al. an elasticized sweatband combined with a detachably connected visor element (or cap) is disclosed. The visor element has a forehead portion but the sweatband includes fastening means on its forward face which likewise diminishes the impact, effectiveness and overall acceptability of the sweatband as a marketing tool when worn separately.

As can be understood from the foregoing, there remains a need within the art for a segmented cap having detachable components that can be utilized as marketing tools when worn separately. The use of hook and loop tape self-engaging fastening means or other nonprintable fastening means imposes limitations on the segmented caps of the prior art overcome by the present invention.

SUMMARY OF THE INVENTION

The segmented cap assembly of the present invention comprises three selectively detachable elements which can be worn in various configurations that permit the forehead portion of each element to be used for display of a company logo, trademark or tradename. The cap includes a visor component having a forehead or billboard portion, a sweatband component having a printable forward face, and a crown component. In a further embodiment of the segmented cap of the present invention the visor component and sweatband component are combined into a single element.

An object of the present invention is to provide a segmented cap assembly having detachable components that can be used for display of printed matter on the forehead portion of each component.

Another object of the present invention is to provide a segmented cap assembly that presents a clean and neat appearance in each of its various wear configurations.

It is also an object of this invention to provide a segmented cap assembly that can be easily assembled and disassembled to and from the various wear configurations.

A further object of this invention is to provide a segmented cap assembly that is comfortable to the wearer's head in all wear configurations.

A still further object of the present invention is to provide a cap assembly where the crown component can be worn as a skull cap separate from the visor component.

These and other objects and advantages of the segmented cap assembly of the present invention will be apparent to those skilled in the art from the following description of preferred embodiments, claims and appended drawings.

DESCRIPTION OF PREFERRED EMBODIMENTS

Figure 1:
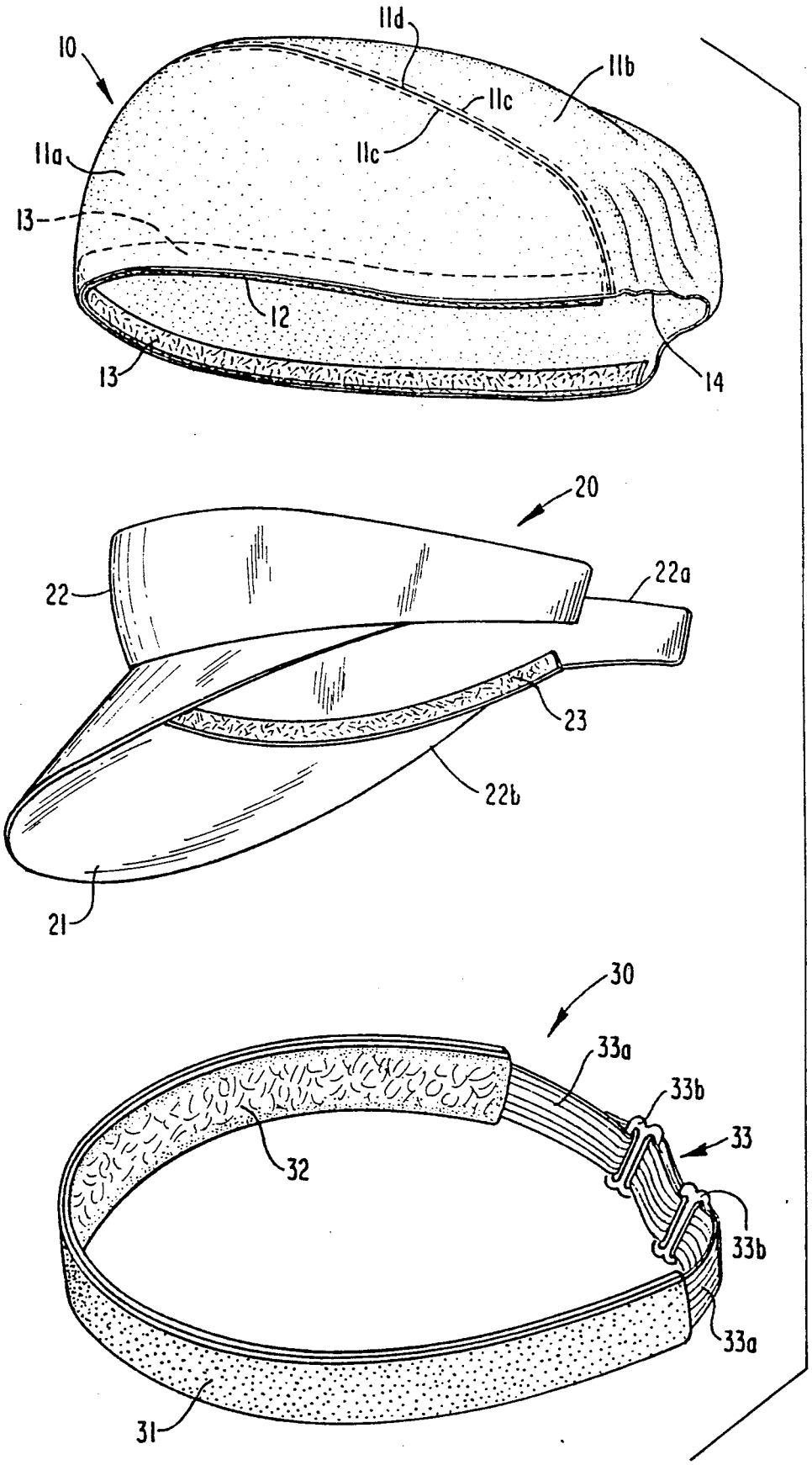
FIG. 1 is an exploded side perspective view of a first embodiment of the segmented cap assembly of the present invention.

FIG. 1 illustrates in an exploded perspective view a first preferred embodiment of a segmented cap assembly 1 constructed in accordance with the teachings of the present disclosure. First segmented cap assembly 1 includes a crown component 10, a visor component 20, and a sweatband component 30. Each of the several components 10, 20, 30 are detachably connectable to each other as hereinafter described in greater detail.

Crown component 10 of first segmented cap assembly 1 generally comprises a body of flaccid material 11 having a hemmed lower edge 12 and a length of the hook portion of hook and loop tape material, such as the material sold under the trademark VELCRO, fixedly attached to the inside portion of the body of flaccid material 11 adjacent to the hemmed lower edge 12 forming crown attachment means 13. In the first preferred embodiment of the segmented cap assembly 1 the crown component 10 includes side crown portions **11*a* and a central crown portion 11*b*, said side crown portions 11*a* being attached to respective sides of said central crown portion 11*b* by stitching means 11*c* to form smooth seams 11*d* therebetween. The crown attachment means 13 extends between the respective seams 11*d* at the rear part of the crown component 10 in a continuous length around the side crown portions 11*a* and the forward part of the central crown portion 11*b*. A length of elastic material 14 is fixedly attached along the rear part of the central crown portion 11*b* at the hemmed lower edge 12 thereof to provide means for head size adjustment of the crown component 10. The outside surface of the forward part of the central crown portion 11*b*** can be utilized for display of a company logo, trademark or tradename.

Visor component 20 comprises integrally-formed bill portion 21 and forehead portion 22. The forehead portion 22 extends substantially vertical from the bill portion 21 and provides an area for display of printed matter, such as a company logo, trademark or tradename. The integrally-formed bill portion 21 and forehead portion 22 is preferably formed from a plastic material of moderate stiffness. Visor component 20 further includes a length of the hook portion of hook and loop tape material, such as the material sold under the trademark VELCRO, fixedly attached to the inside surface **22*a* of the forehead portion 22 along the lower edge 22*b* of the forehead portion 22 forming visor attachment means 23**.

Sweatband component 30 comprises a length of non-elasticized hook and loop tape hook portion-engaging material 31, as manufactured by Guilford Mills Inc. of New York, N.Y., fixedly attached back-to-back to a length of non-elasticized terrycloth material 32. A limitation of the segmented caps in the prior art is the use of the hook portion of hook and loop tape material and the loop portion of hook and loop tape material on the respective components that are to be attached. Neither the hook portion nor the loop portion of hook and loop tape material can be easily printed upon and when exposed it does not present a neat and clean appearance. The use of hook and loop tape hook portion-engaging material 31 overcomes these limitations. Hook and loop tape hook portion-engaging material 31 is a smooth, closely woven fabric which thusly can be printed on using conventional processes, and specifically adheres to the hook portion of hook and loop tape material, and therefore can replace the loop portion of hook and loop tape material For head size adjustment of the sweatband component 30 an elasticized strap assembly 33 is fixedly attached to respective ends of the attached lengths of non-elasticized hook and loop tape hook portion-engaging material 31 and non-elasticized terrycloth material 32. Strap assembly 33 comprises a plurality of elastic bands **33*a* interconnected in sliding engagement to adjustment clips 33*b*** as generally known in the art.

Figure 2:
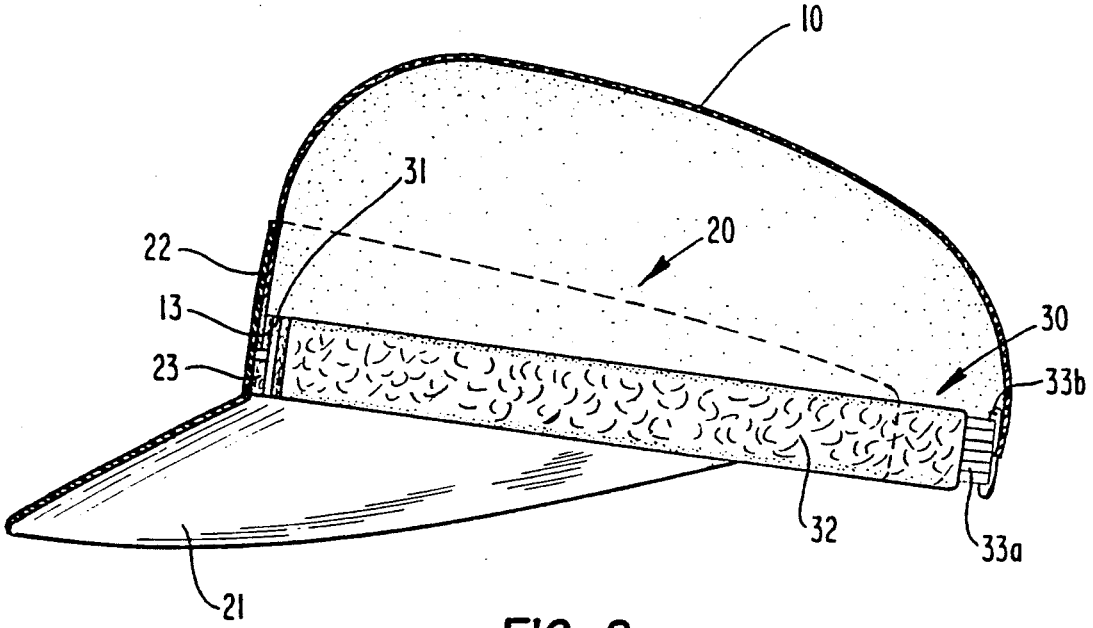
FIG. 2 is a side cross-sectional view of an assembled first segmented cap assembly.
Figure 3:
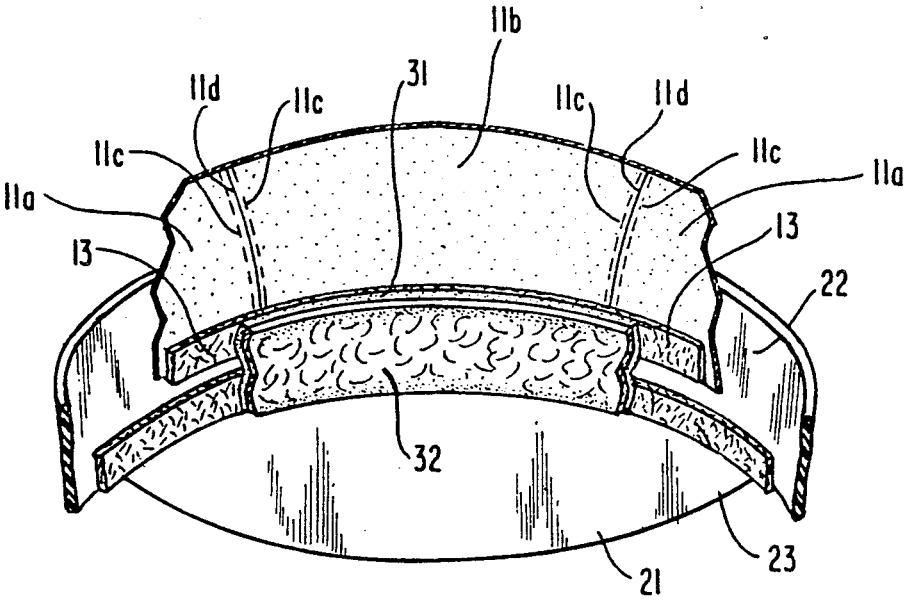
FIG. 3 is a partially fragmented rear perspective view of the first cap assembly.

FIG. 2 illustrates in a side cross-sectional view the attachment of the crown component 10, the visor component 20 and the sweatband component 30. The width of the sweatband component 30 is at least equal to the combined width of the crown attachment means 13 of the crown component 10 and the visor attachment means 23 of the visor component 20. The forward part of the crown component 10 is disposed behind the forehead portion 22 of the visor component 20 having the crown attachment means 13 engaging the upper half of the length of non-elasticized hook and loop tape hook portion-engaging material 31 of the sweatband component 30. The visor attachment means 23 engages the lower half of the length of non-elasticized hook and loop tape hook portion-engaging material 31 of the sweatband component 30 (FIG. 3). Thereby the three components 10, 20, 30 are held together to form an integrated cap assembly.

A particular advantage of the segmented cap assembly 1 of the present invention is the provision of a cap comprising components that can be used separately for display of printed matter, such as a company logo, trademark or tradename at the forehead of the wearer. The use of hook and loop tape hook portion-engaging material 31 in lieu of the loop portion of hook and loop tape material, as known in the prior art, on the forward face of the sweatband component 30, permits the sweatband component 30 to be worn alone and separate as a marketing tool having a neat and clean appearance and which can be printed thereupon. The prior art segmented caps using the loop portion of hook and loop tape material on the forward face of the sweatband can neither be printed on nor do they provide a neat and clean appearance that is marketable. To wear the visor component 20 with the sweatband component 30 to provide sun-shading means for the wearer's eyes via the bill portion 21 of the visor component 20, the visor attachment means 23 is attached to the hook and loop tape hook portion-engaging material 31 of the sweatband component 30. A company logo, trademark or tradename can thus be displayed on the forward face of the forehead portion 22 of the visor component 20. To wear the crown component 10 without the visor component, the crown attachment means 13 is attached to the hook and loop tape hook portion-engaging material 31 of the sweatband component 30. Printed matter can then be displayed upon the forward part of the body of flaccid material 11.

Figure 5:
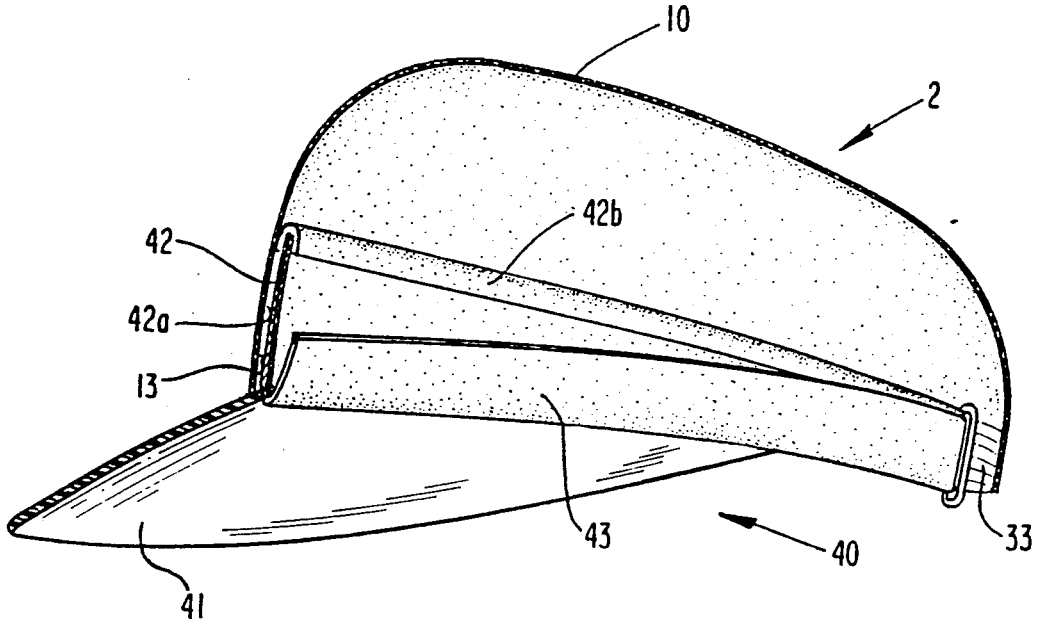
FIG. 5 is a side cross-sectional view of the second segmented cap assembly showing the attachment of the crown component thereto.
Figure 4:
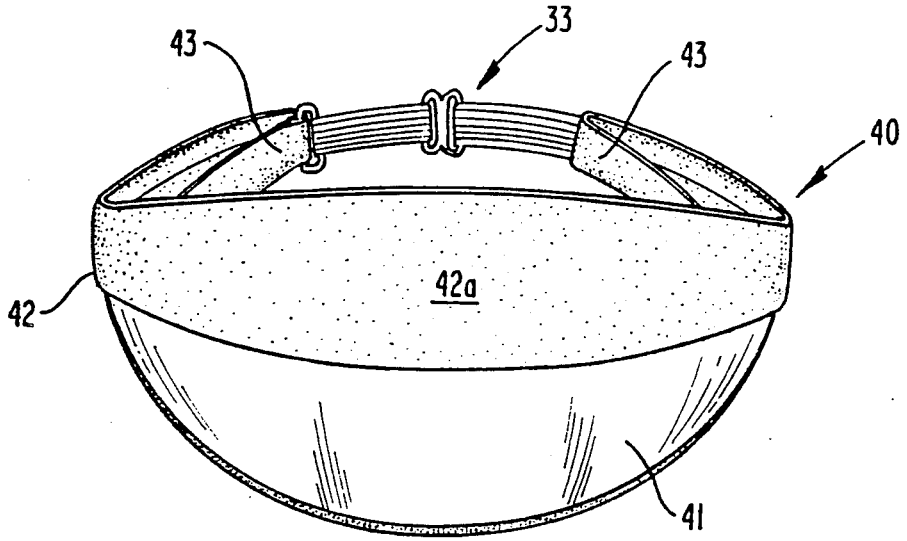
FIG. 4 is a front perspective view of the visor component of a second embodiment of the segmented cap assembly of the present invention.

FIGS. 4 and 5 illustrate a second embodiment of a segmented cap assembly 2 constructed in accordance with the teachings of the present disclosure. Second segmented cap assembly 2 comprises a visored headband component 40 and a crown component 10. Crown component 10 is constructed as heretofore described for the first segmented cap assembly 1. Visored headband component 40 includes a bill portion 41, a forehead portion 42, and a sweatband portion 43. Bill portion 41 is preferably formed from a plastic material of moderate stiffness. Forehead portion 42 is formed having a forward face **42*a* comprising hook and loop tape hook portion-engaging material. The forehead portion 42 is fixedly attached at the lower edge thereof to the bill portion 41 and extends beyond the sides of the bill portion 41 for a length substantially to the rear of the wearer's head. A seam cover 42*b* is fixedly attached to the forehead portion 42 along the length of the top edge of the forehead portion 42. An elasticized strap assembly 33 as heretofore described is fixedly attached at respective ends of the forehead portion 42. Sweatband portion 43 of the visored headband component 40 (FIG. 5) comprises a length of moisture-absorbent material and is fixedly attached to the bill portion 41 opposite the attachment of said forehead portion 42. Sweatband portion 43 extends upwardly therefrom to the inside of the forehead portion 42**.

As should be understood from the foregoing description of the attachment of the various components of the first segmented cap assembly 1, the visored headband component 40 can be worn separately or the crown component 10 may be attached thereto by engagement of the crown attachment means 13 to the forward face **42*a* of the forehead portion 42 of the visored headband component 40**.

Various changes and modifications may be made to the preferred embodiments of the present disclosure without departing from the spirit and scope of the present invention. Such changes and modifications within a fair reading of the following claims are intended as part of the present disclosure.

Therefore in view of the foregoing, I claim:

1. A segmented cap assembly comprising a crown component comprising a central crown portion and two side crown portions, said side crown portions being fixedly attached to respective sides of said central crown portion, a length of elastic being fixedly attached at a rear part of said central crown portion, said crown component having crown attachment means fixedly attached to an inside portion thereof; and a sweatband component comprising a length of hook and loop tape hook portion-engaging material fixedly attached back-to-back to a length of terry-cloth material, the ends of the respective lengths of material being selectively attachable to each other, said crown component being selectively attachable to said sweatband component by engagement of said crown attachment means to said length of hook and loop tape hook portion-engaging material.

2. A segmented cap assembly as in claim 1 wherein said crown attachment means comprises a length of the hook portion of hook and loop tape material.

3. A segmented cap assembly as in claim 1 wherein the ends of the respective lengths of material are selectively attachable to each other by means of an adjustable strap assembly fixedly attached at respective ends of said length of hook and loop tape hook portion-engaging material.

4. A segmented cap assembly comprising three separable components consisting of a crown component, a sweatband component and a visor component, said crown component and said visor component being respectively singularly or jointly selectively attachable to said sweatband component, said crown component comprising a body of material having crown attachment means fixedly attached to an inside portion of said body of material;

said sweatband component comprising a length of hook and loop tape hook portion-engaging material fixedly attached back-to-back to a length of terry-cloth material, the ends of the respective lengths of material being selectively attachable to each other, and said visor component comprising an integrally-formed bill portion and forehead portion, said forehead portion extending substantially vertical from said bill portion, visor attachment means being fixedly disposed on an inside surface of said forehead portion, said crown component being selectively attachable to said sweatband component by engagement of said crown attachment means to said length of hook and loop tape hook portion-engaging material, said visor component being selectively attachable to said sweatband component by engagement of said visor attachment means to said length of hook and loop tape hook portion-engaging material.

5. A segmented cap assembly as in claim 4 wherein said visor attachment means comprises a length of the hook portion of hook and loop tape material.

6. A segmented cap assembly as in claim 4 wherein said visor component is formed from a plastic material of moderate stiffness.

7. A segmented cap assembly as in claim 4 wherein the width of said sweatband component is at least the combined width of the crown attachment means of said crown component and the visor attachment means of said visor component, said crown attachment means being attachable to the upper half of said sweatband component and said visor attachment means being attachable to the lower half of said sweatband component.

8. A segmented cap assembly comprising a crown component comprising a body of flaccid material having crown attachment means fixedly attached to an inside portion of said body of material, said crown component comprising a central crown portion and two side crown portions, said side crown portions being fixedly attached to respective sides of said central crown portion, a length of elastic being fixedly attached at a rear part of said central crown portion, and a visored headband component comprising a bill portion, a forehead portion and a sweatband portion, said forehead portion having a forward face formed from hook and loop tape hook portion-engaging material, said forehead portion being fixedly attached at a lower end thereof to said bill portion, said sweatband portion being fixedly attached at a lower end thereof to said bill portion opposite to the attachment of said forehead portion to said bill portion and disposed to an inside of said forehead portion, said crown component being selectively attachable to said visored headband component by engagement of said crown attachment means to the forward face of said forehead portion formed from said hook and loop take hook portion-engaging material.

9. A segmented cap assembly comprising a crown component comprising a central crown portion and two side crown portions, said side crown portions being fixedly attached to respective sides of said central crown portion, a length of elastic being fixedly attached at a rear part of said central crown portion, said crown component being formed from a body of flacid material, crown attachment means being fixedly attached to an inside portion of said crown component, said crown attachment means comprising a length of the hook portion of hook and loop tape material a sweatband component comprising a length of hook and loop tape hook portion-engaging material fixedly attached back-to-back to a length of terry-cloth material, the ends of the respective lengths of material being selectively attachable to each other, said crown component being selectively attachable to said sweatband component by engagement of said crown attachment means to said length of hook and loop tape hook portion-engaging material.

10. A segmented cap assembly as in claim 9 further including a visor component formed from a plastic material of moderate stiffness comprising an integrally-formed bill portion and forehead portion, said forehead portion extending substantially vertical from said bill portion, visor attachment means being fixedly disposed on an inside surface of said forehead portion, said visor attachment means comprising a length of the hook portion of hook and loop tape material said visor component being selectively attachable to said sweatband component by engagement of said visor attachment means to said length of hook and loop tape hook portion-engaging material, the width of said sweatband component being at least the combined width of the crown attachment means of said crown component and the visor attachment means of said visor component, said crown attachment means being attachable to the upper half of said sweatband component and said visor attachment means being attachable to the lower half of said sweatband component.

11. A segmented cap assembly comprising a crown component comprising a central crown portion and two side crown portions, said side crown portions being fixedly attached to respective sides of said central crown portion, a length of elastic being fixedly attached at a rear part of said central crown portion, said crown component being formed from a body of flaccid material, crown attachment means being fixedly attached to an inside portion of said crown component, said crown attachment means comprising at length of the hook portion of hook and loop tape material, and a visored headband component comprising a bill portion, a forehead portion and a sweatband portion, said forehead portion having a forward face formed from hook and loop tape hook portion-engaging material, said forehead portion being fixedly attached at a lower end thereof to said bill portion, said sweatband portion being fixedly attached at a lower end thereof to said bill portion opposite to the attachment of said forehead portion to said bill portion and disposed on an inside of said forehead portion, said crown component being selectively attachable to said visored headband component by engagement of said crown attachment means to the forward face of said forehead portion formed from said hook and loop tape hook portion-engaging material.

* * * * *